US005251548A

United States Patent [19]

Spence

[11] Patent Number: 5,251,548

[45] Date of Patent: Oct. 12, 1993

[54] MISSILE ACCELERATION AND ARMING DEVICE

[75] Inventor: John J. Spence, Oakland, N.J.

[73] Assignee: AlliedSignal Inc., Morris Township, Morris County, N.J.

[21] Appl. No.: 325,526

[22] Filed: Nov. 27, 1981

[51] Int. Cl.[5] ..... F42C 15/40

[52] U.S. Cl. ..... 102/221

[58] Field of Search ..... 102/215, 221, 262

[56] References Cited

U.S. PATENT DOCUMENTS 3,622,987 11/1971 Borkan ..... 102/215
4,099,466 7/1978 Redmond et al. ..... 102/215
4,375,192 3/1983 Yates et al. ..... 102/215

*Primary Examiner*—Charles T. Jordan
*Attorney, Agent, or Firm*—Howard G. Massung

[57] ABSTRACT

A safing and arming device for warheads that can enhance arming safety is described. The device is initially enabled upon detection of an acceleration threshold. Thereafter, an accelerometer and other circuitry are used to generate a digitized profile of the acceleration of a projectile, on which the device is mounted, over a short period of time. Each point of the digitized profile is used to address a memory to read out a binary word bit by bit. The binary word read out of memory is compared to a stored binary word and upon there being a match between the two words a signal is generated to arm the missile warhead. To counteract a sticking accelerometer which can generate a false acceleration profile, extra safety is provided by applying an acceleration bias to the accelerometer at intervals determined by bits of the binary word read out of memory, which bias is effectively removed by choice of the memory locations in which the binary word is stored.

10 Claims, 4 Drawing Sheets

MISSILE ACCELERATION AND ARMING DEVICE

This invention was made under a U.S. Government contract.

FIELD OF THE INVENTION

This invention relates to missile acceleration arming devices for munitions.

BACKGROUND OF THE INVENTION

As time has gone on new more stringent requirements have been generated for safing and arming devices for missiles carrying munitions. The response of the munitions in various abnormal situations, such as vehicular accidents, aircraft crashes, fires, explosions, and direct hits by lightning is of primary concern. Current safing and arming devices whose outputs are typically electrical switch closures easily fail under most abnormal environments by shorting or crushing of the contacts. A secondary failure mode is established by a complete bypassing of the safing and arming device due to electrical shorts.

Thus, there is a need in the art for a safing and arming device that is immune from giving an arming signal to the missile munitions under abnormal situations.

I satisfy this need in the prior art by providing a new safing and arming device that generates a coded signal instead of a switch contact closure and does not generate an invalid arming signal under abnormal situations.

SUMMARY OF THE INVENTION

In accordance with the teaching of my invention I provide a new safing and arming device that is first enabled to function upon sensing an acceleration threshold. Then, periodic samples of the output of an accelerometer are taken to develop an acceleration profile which is checked to see if it matches the acceleration profile for the missile on which the safing and arming device is located. The acceleration profile is checked by periodically digitizing the output of the accelerometer and then using the binary numbers generated to address a memory in which is stored an arming word. If the proper acceleration profile is experienced the arming word is read out of the memory, otherwise not. A comparator is used to check the word read out of memory with the known arming word and, if there is a match, an arming signal is generated and used to arm the missile munitions.

Another safety feature is provided that prevents a sticking accelerometer from generating an output signal that falsely lies within the acceleration profile for the missile. Digits of the binary word read out of the memory cause a bias to be occasionally applied to the accelerometer. This bias affects the memory bits addressed but is effectively removed by placing each bit of the arming word stored in the memory in the location that is addressed by the binary number which is the combination of the bias plus the normal accelerometer output.

DESCRIPTION OF THE DRAWING

My invention will be best understood upon reading the following detailed description in conjunction with the drawing in which.

DETAILED DESCRIPTION

Figure 1:
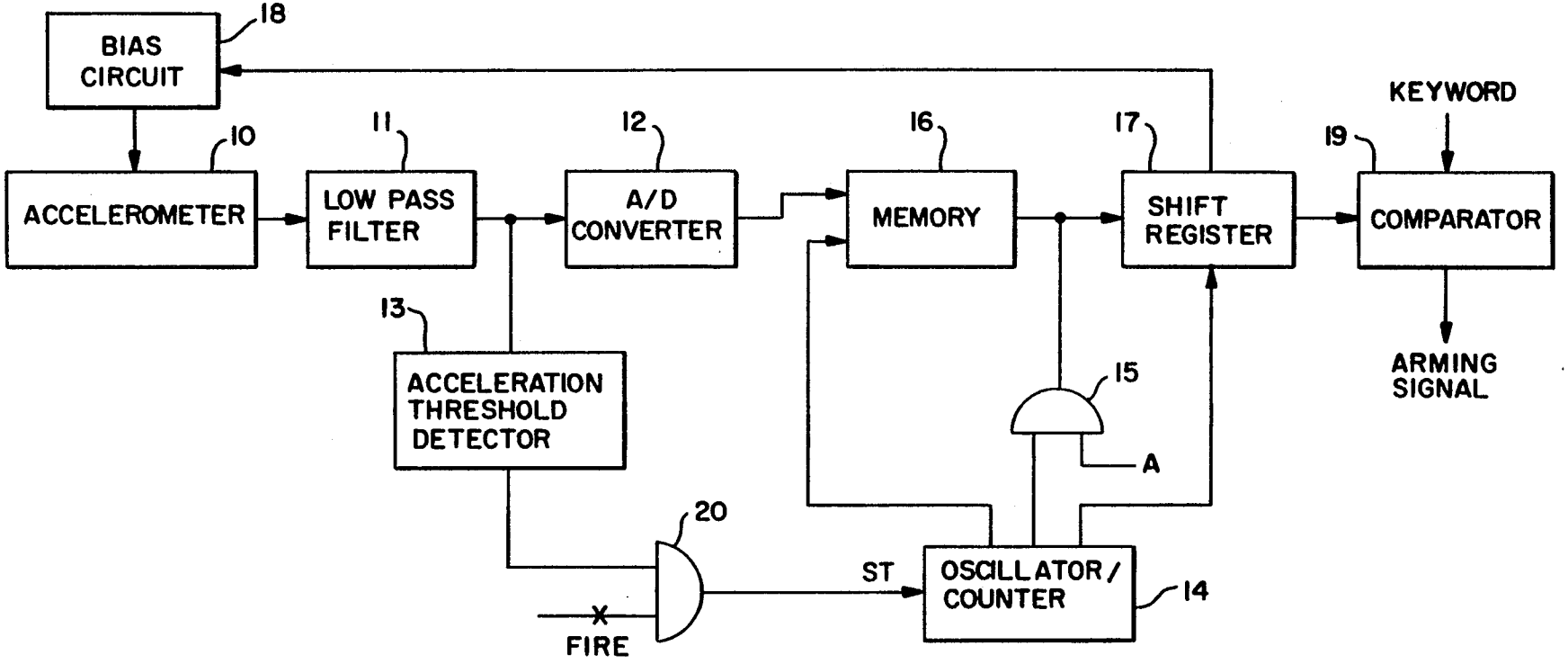
FIG. 1 is a detailed block diagram of my novel safing and arming system.

Turning now to FIG. 1, therein is shown the detailed block diagram of my novel safing and arming system. Accelerometer 10 generates an analog voltage directly proportional to the acceleration experienced by my novel device including accelerometer 10. Such accelerometers are well known in the art. "Such an accelerometer is the Mini-Pal, Model 2180, Servo Accelerometer, PN 971-0027-001 from Sundstrand Data Control Inc. of Redmond, Wash. and is disclosed in detail in their manual, No. 012-0276-001 dated Jun. 17, 1977." The analog voltage output from accelerometer 10 is applied to a conventional low-pass filter 11 which effectively removes noise generated by the missile vibration spectrum. The filtered analog voltage output is applied to both analog-to-digital converter 12 and acceleration threshold detector 13. Converter 12 converts the analog voltage input thereto into a binary number which is applied to a portion of the addressing inputs of memory 16. In this embodiment of my invention memory 16 is preferably a read-only memory in which has been written a twenty bit binary number which has been arbitrarily selected and which I call the safing and arming keyword. For the example given further in this specification the twenty bit binary number key word is shown on FIG. 2.

For my novel safing and arming system to be enabled to operate, the acceleration threshold detector 13 must first detect an analog voltage output from low pass filter 11 indicating that accelerometer 10 is experiencing, for example a 5 G acceleration. "Detector 13 is implemented in a manner well known in the art using an LM 139 Voltage Comparator available from National Semiconductor. A voltage is applied to this voltage comparator equal to the voltage from accelerometer 10 when it senses a 5 G acceleration and this is compared to the actual voltage output from the accelerometer." However, this alone does not enable my safing and arming system because an abnormal situation such as a crash may create this acceleration response. The next step to be satisfied in enabling my safing and arming system is to check and see if concurrent with the 5 G acceleration the FIRE control for the missile on which my safing and arming system is located has been operated. This check is made by AND gate 20. Acceleration threshold detector 13 provides one of the two inputs to AND gate 20 while the FIRE button for the missile provides the second input to this gate. Only when both conditions are met is there an output from gate 20 which is used to start oscillator/counter 14.

Figure 2:
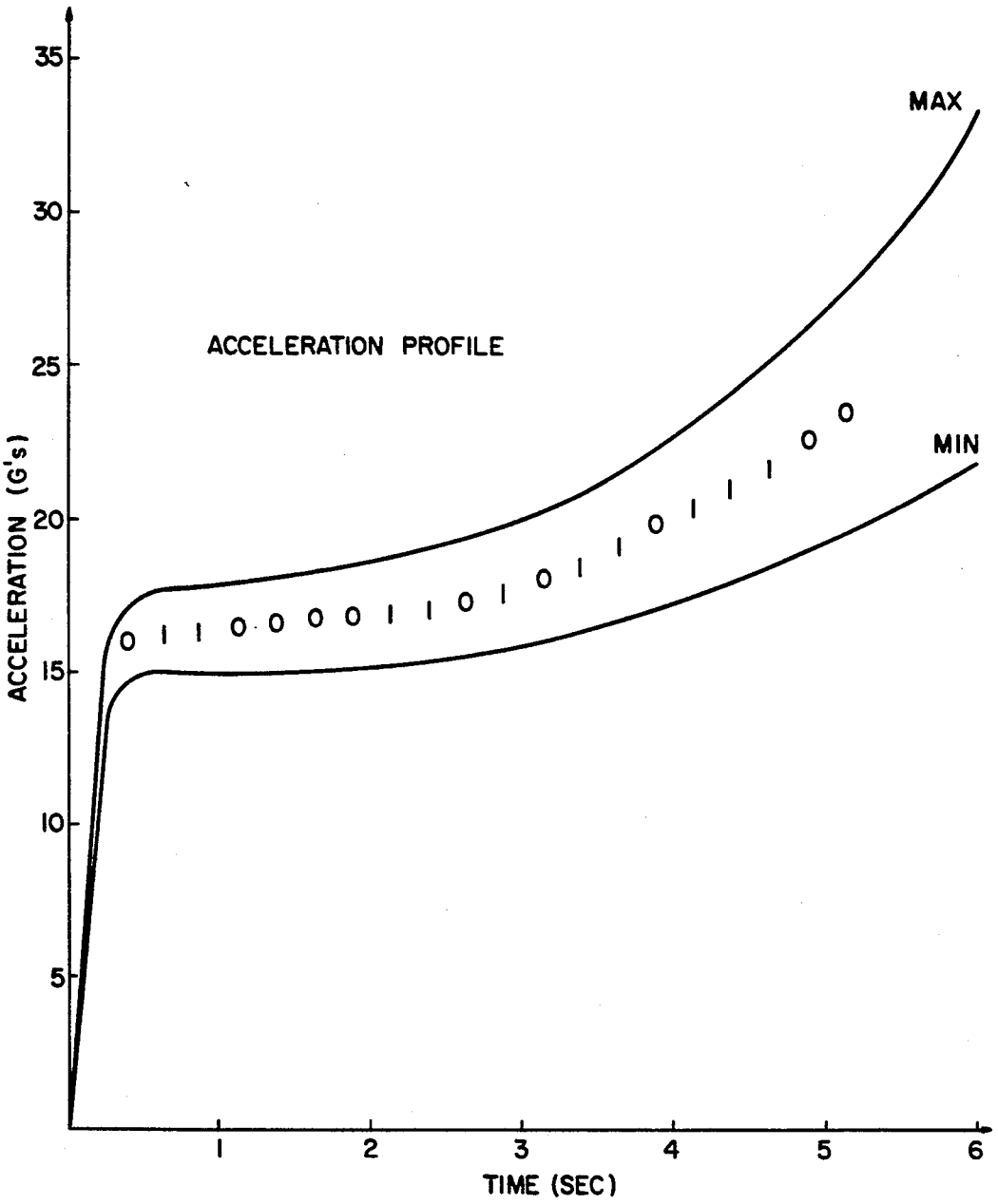
FIG. 2 shows the output of the accelerometer indicating the acceleration profile of a missile.

The next interlock in my safing and arming system is to observe the acceleration profile of the missile over a period of several seconds to determine if this acceleration profile matches that of the missile in which my novel safing and arming system is located. In FIG. 2 are shown maximum and minimum acceleration profile curves for an exemplary missile. In actuality, the acceleration profile for a given one of the exemplary missiles will generate an acceleration profile which will fall between the minimum and maximum curves. As mentioned previously the acceleration experienced by accelerometer 10 results in a binary number being applied to a portion of the addressing inputs of memory 16. The remaining addressing inputs of memory 16 are obtained from oscillator/counter 14 which is first enabled to count upon the concurrence of the FIRE command and the 5 G acceleration threshold as previously described. The combination of these two addressing inputs to memory over a period of five seconds causes twenty acceleration profile samples to be taken by reading out twenty bit locations in memory 16. Within these twenty bit locations is stored the twenty bit arming key word shown in FIG. 2 when there is a proper acceleration profile. If the proper acceleration profile is not being experienced at each sample point over the five second period none or only part of the arming key word is read out of memory 16 and the safing and arming device does not cause the missile warhead to be armed as is detailed hereinafter.

The following description is initially simplified in order to understand how the safing and arming key word is read out of memory 16. With reference to FIG. 2, after oscillator/counter 14 is enabled, if one quarter second into the missile flight an acceleration of 15 G's, for example, is sensed by accelerometer 10, the two addressing inputs of memory 16 will cause a 0 to be read out of the memory, which 0 is the first bit of the arming key word. If at this one quarter second point in time acceleration is sensed that is outside an acceptable range of, for example, 12.5 G's to 15 G's a 1 will be read out of memory 16. Similarly, one-half second into the missile flight if the sensed acceleration is within the acceptable range of 15 to 17.5 G's a 1 will be read out of memory, which 1 is the second bit of the arming key word. Outside of this acceptable range 0's will be read out of memory 16. This procedure is repeated for every one-quarter second acceleration period sampling period to check the acceleration of the missile over twenty samples to determine if the missile is undergoing its proper acceleration profile. This is prerequisite to arming the warhead.

Whether or not the acceleration experienced by the missile falls within the acceleration profile, a twenty bit binary word will be serially read out of memory 16 and placed in shift register 17. If the sensed acceleration falls within the proper acceleration profile, the twenty bit binary word read out of memory 16 will be the arming key word shown on FIG. 2, otherwise not. Whatever twenty bit binary word is serially read out of memory 16 is stored in shift register 17 the output of which is applied to comparator 19 which compares the binary word stored in the register to the actual arming key word. In the event that comparator 19 determines that the arming key is stored in shift register 17 an arming signal is used to arm the warhead on the missile. If there is no arming key word match, no arming signal is output from comparator 19.

Another problem may occur when the sensed acceleration does not fall within the proper acceleration profile range at all. The twenty bit binary word read out of memory 16 is the exact complement of the twenty bit arming key word shown on FIG. 2. This can create a problem in the event that there is some abnormal condition occurring within the safing and arming device. The non-valid binary word can be inverted to become the arming key word and the warhead will be inadvertently and wrongfully armed. To overcome this possibility oscillator/counter 14 provides an output to AND gate 15 which provides an input to shift register 17 only during the first sample period to force the first bit of the valid arming key word into this shift register. In doing this, the exact complement of the arming key word will never appear in shift register 17 and, therefore, the contents may never be inverted to become the arming key word.

Yet another problem may occur in that accelerometer 10 may fail in a manner that provides an output that falls between the minimum and maximum ranges of the acceleration profile shown in FIG. 2. To overcome this problem, bias circuit 18 is provided which receives its input from the first stage of shift register 17 and responds to the bit stored therein at each moment in time. The purpose of bias circuit 18 is to apply a 15 G bias to whatever acceleration is sensed by and output from accelerometer 10, whether the acceleration is a true value or is created by a defective accelerometer. "The bias input to the accelerometer is used for this purpose as is known in the art."

Figure 3:
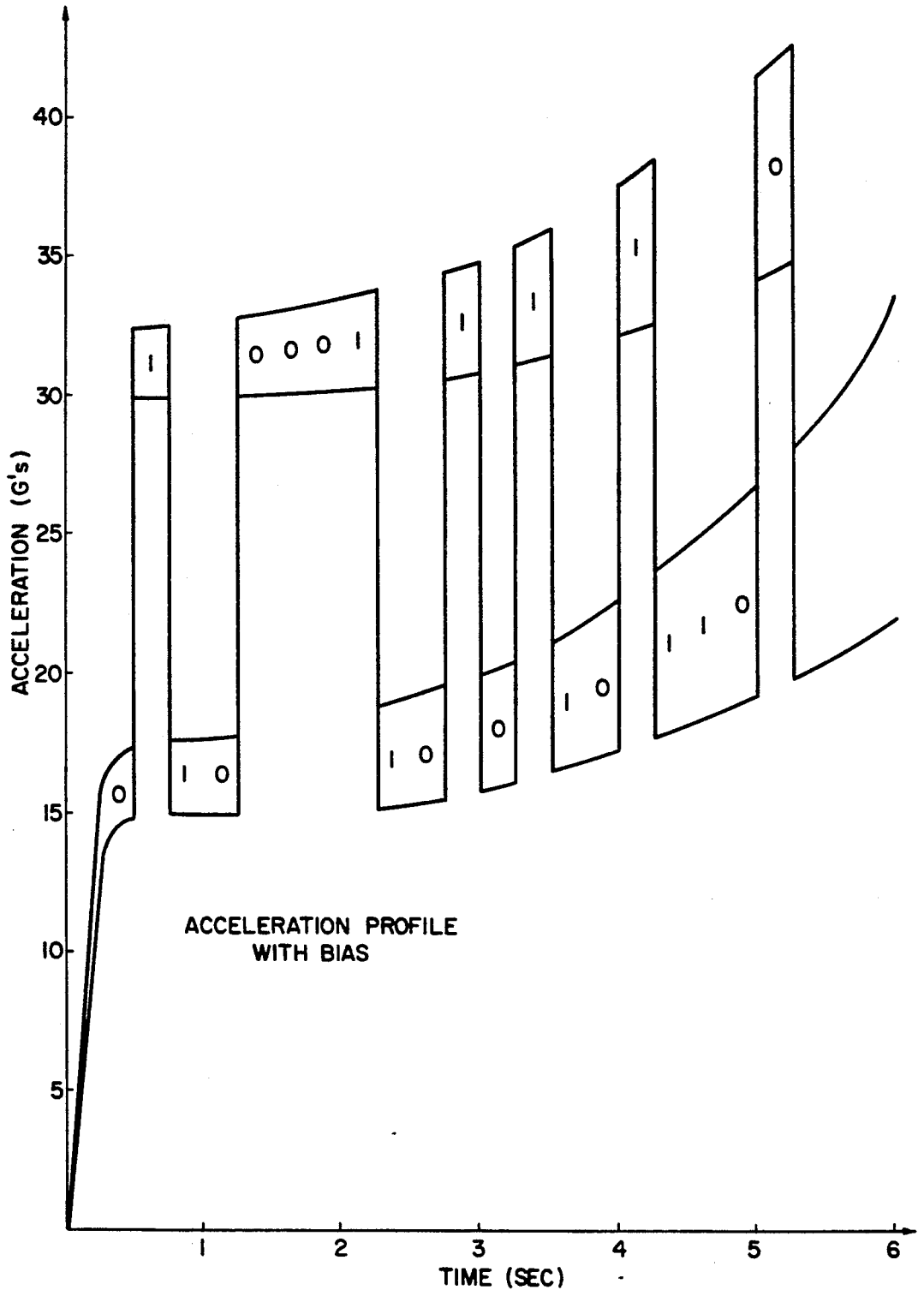
FIG. 3 shows the output of the accelerometer indicating the accelerometer profile of a missile with bias applied thereto.

With reference to FIG. 3, every time a 0 bit appears in the first stage of shift register 17, bias circuit 18 responds thereto to apply the 15 G bias to the output of accelerometer 10. Every time a 1 bit is sensed in the first stage of shift register 17 bias circuit 18 responds thereto to remove the 15 G bias applied to the output of accelerometer 10. This results in the curve shown in FIG. 3. Every time a 0 bit is sensed in shift register 17, bias circuit 18 causes the output of accelerometer 10 to go from the normal acceleration profile to the biased acceleration profile. Every time a 1 is sensed in the first stage of shift register 17 bias circuit 18 causes the output of accelerometer 10 to change from the biased acceleration profile curve back to the normal acceleration profile curve, both shown in FIG. 3. As can be readily understood, the higher G values output from accelerometer 10 with bias applied thereto cause higher value binary numbers to be output from analog-to-digital converter 12. This results in different bit locations of memory 16 being addressed than if there were no bias applied to accelerometer 10. This bias is effectively removed by storing particular bits of the arming key word in appropriate positions of memory 16 so that these particular arming key word bits are read out of memory 16 when bias is being applied to the output of accelerometer 10 by bias circuit 18.

Figure 4:
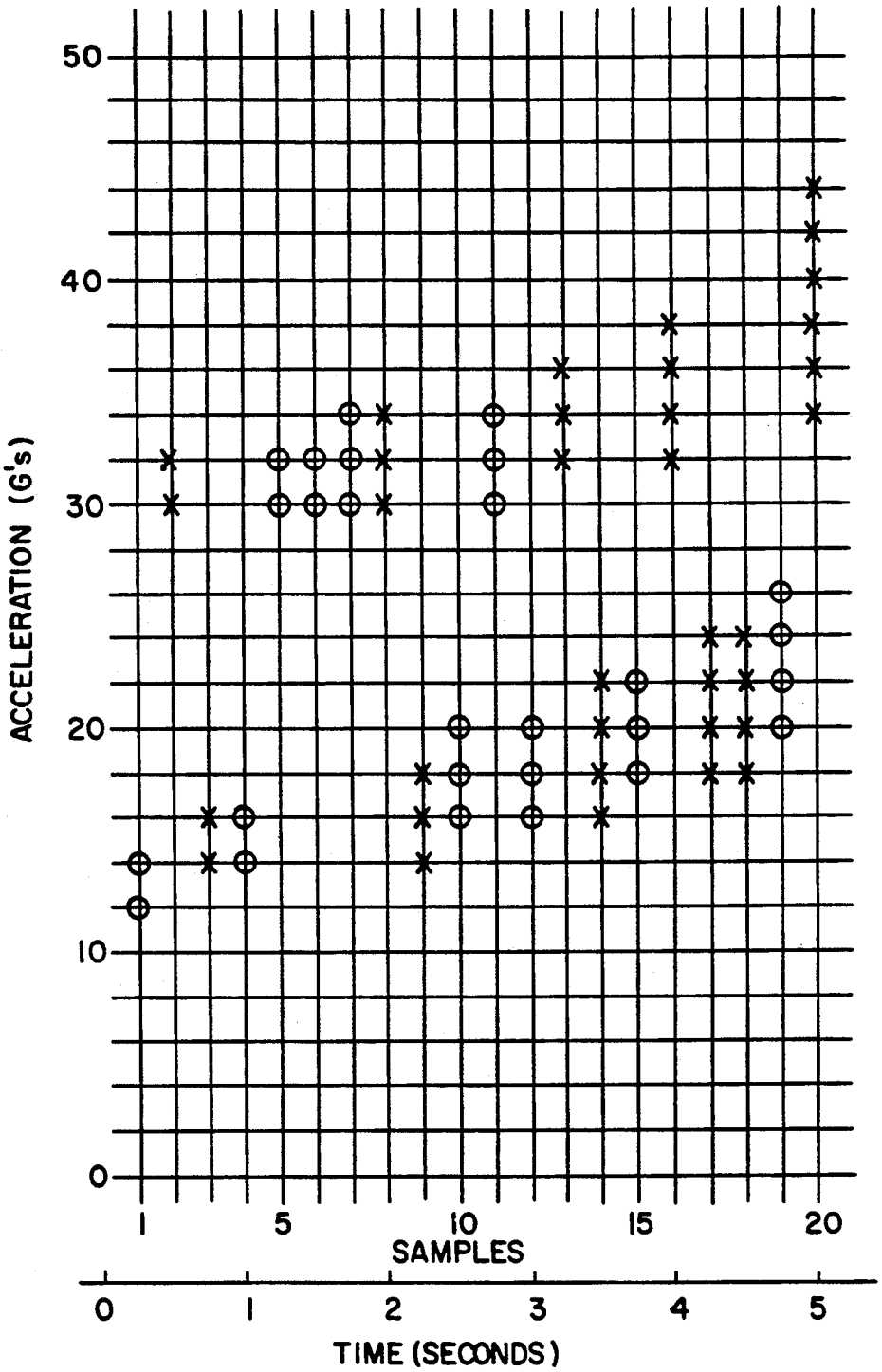
FIG. 4 reflects how the arming word is stored in the memory.

The operation of memory 16 is pictorially shown in FIG. 4 which representatively shows memory bit locations within the memory. On the left side of this pictorial representation are twenty five lines representing the values of the acceleration in increments of two between the values of zero and fifty. The binary number output from analog-to-digital converter 12 in FIG. 1 to the first portion of the addressing inputs of memory 16 will address one of these lines. In reality the addresses output from analog-to-digital converter 12 address more than twenty five lines of memory 16. In the preferred embodiment there are 256 lines. What is shown in FIG. 4 is meant only to aid in understanding how bits are written into memory 16 so that the arming key word may be read out therefrom upon the missile in which the safing and arming device is located accelerates in such a fashion that accelerometer 10 detects a proper acceleration profile.

The remaining addressing inputs to memory 16 are energized from oscillator/counter 14, as previously mentioned, which causes one of the twenty vertical lines to be selected. This causes one of the vertical lines marked SAMPLES to be energized every one quarter second. The combination of the two addressing inputs to memory 16 causes a memory bit location within memory 16 to be read out every one quarter second.

Before describing how selected bits in memory 16 are written into, I first describe the pictorial representation thereof shown in FIG. 4. An "x" at the junction of a horizontal and vertical line in FIG. 4 indicates that the memory bit location represented by the junction of these two lines has a 1 written therein and, similarly, a small "zero" at the junction of lines indicates that a 0 bit is written in the memory bit represented thereby. In FIG. 4 only a small number of junctions of horizontal and vertical lines have an "x" or an "o" indicated thereon. However, information is placed in all the other bits of the memory which is not shown in FIG. 4 to avoid cluttering up the figure and thereby detracting from an understanding of how bits are stored in memory 16 for the arming key word. For example, along the vertical line indicated as sample 20 there are "x's" shown at the intersection with the six horizontal lines representing 34, 36, 38, 40, 42 and 44 G's. As just described this represents that there are 1's stored in the memory locations represented by these intersections. There are 0's recorded at all other memory locations represented by the remaining junctions along sample line 20. For another example, vertical sample line 12 has "o's" at the junctions with horizontal lines representing 16, 18 and 20 G's. All other memory bits represented by the remaining intersecting line junctions along vertical sample line 12 have one's stored therein. Thus, there are carefully stored at every bit of memory 16 a 0 or a 1 all of which are not shown in the pictorial representation of FIG. 4, but which are required for the invention to work properly.

The "x's" and "o's" shown on FIG. 4 represent the arming key word given in FIG. 2 but more accurately shown in FIG. 3 with acceleration bias. For example, the first bit of the arming key word is the 0 shown between the curve roughly between 13 and 17 G's and between one quarter and one half seconds. In FIG. 4, this first zero bit is represented by the three 0's along vertical sample lines where it intersects the horizontal lines for 12, 14 and 16 G's. The second arming key word bit is a 1 shown within the acceleration profile curve between one half and three quarter seconds. Reflecting the acceleration bias and the fact that the second key word bit is a 1 there are two x's representing ones along vertical sample line 2 where it intersects the horizontal lines for 30 and 32G's. In this same manner each of the twenty bits of the arming key word are effectively stored within memory 16 to reflect the acceleration profile of FIG. 3 with and without acceleration bias as appropriate. The number of x's or o's shown along each vertical sample line in FIG. 4 is a function of the vertical width of the acceleration profile curve in FIG. 3. The twentieth bit of the arming key word is a 1 and in FIG. 3 is between five seconds and five and one quarter seconds and between 34 and 40G's. This requires that the six intersection along vertical sample line 20 of FIG. 4 be marked with an x as shown.

In the event that accelerometer 10 senses accelerations within the acceleration profile for the missile on which the safing and arming system is located each of the twenty bits of the arming key word serially stored in memory 16 are read out over the sampling period between one quarter to five and one quarter seconds. Irregardless of whether the first bit of the arming key word read out of memory 16 is a 0 or a 1, AND gate 15 operates as previously described to force the first bit of the arming key word into shift register 17 as the first bit placed therein. As previously described, this is done to prevent arming the warhead upon an inadvertent phase shift of a non-valid complementary signal being in shift register 17. The contents of shift register 17 are compared to the valid arming key word by comparator 19. If there is a match between these two, indicating that the arming key word is indeed stored in shift register 17, there is an output from comparator 19 called the ARMING SIGNAL which is used to arm the warhead of the missile. In the event that comparator 19 determines that there is no match there is no ARMING SIGNAL output from comparator 19 and the warhead is not armed.

Now that the operation of all the circuit blocks within my safing and arming device have been described, I now describe the operation of the system through a typical firing sequence.

Initially, my safing and arming system is looking for some initial acceleration threshold before going through the remaining interlocking safety checks leading up to the generation of the ARMING SIGNAL. In the event that the missile is involved in an accident, undergoes an inadvertent or accidental propulsion system ignition or in any other way experiences acceleration there is an output from accelerometer 10 which is filtered by low pass filter 11 and the signal applied to acceleration threshold circuit 13 which will provide an output signal if, for example, the acceleration exceeds a figure such as 5G's. Due to an inadvertent or accidental acceleration of the missile there is no output from AND gate 20 as the second input to this logic gate is not energized. This second input to logic gate 20 indicates that the firing sequence of the missile has been executed, thereby indicating that the sensed acceleration is not accidental or inadvertent. Upon there being a valid firing of the missile there will be an output from AND gate 20 on start lead ST to oscillator/counter 14 to start the counter counting and providing appropriate timing signals to the circuits within my novel safing and arming device.

At the same time the filtered output from accelerometer 10, which is an analog signal, is converted to a binary number output from oscillator/counter 14 which is applied to the remaining addressing inputs to memory 16. The combination of both addressing inputs causes the contents of a location in memory 16 to be read out. The addressing input from oscillator/counter 14 causes a different bit location within the memory to be read out every one quarter second so that memory contents are being sampled every one quarter second to read a twenty bit binary number out of the memory. This sampling technique is used to determine if the acceleration being sensed by accelerometer 10 is a valid acceleration profile falling within the bounds of the acceleration profile for the missile. In the event that it is not a valid acceleration profile the result is that the binary number read out of memory 16 and shifted through shift register 17 is compared with the true arming key word by comparator 19 which does not indicate a match and there is no ARMING SIGNAL output from comparator 19 to arm the warhead of the missile. However, in the event that the acceleration sensed by accelerometer 10 does fall within the acceleration profile for the missile the arming key word for the system is read out of memory 16 and placed in shift register 17. Comparator 19 determines that there is a match between the true arming key word being input thereto from an external source such as a ROM and the binary number stored in shift register 17. This match causes comparator 19 to generate the ARMING SIGNAL which causes the warhead on the missile to be armed.

However, there is an output from oscillator/counter 14 which coupled with a predetermined second input to AND gate 15 causes a zero to be placed in the first bit of shift register 17 for this exemplary arming key word, instead of the first bit read out of memory 16. The predetermined bit is the same as the first bit of the valid arming key word. Thereafter, there is no further output from AND gate 15. The 0 in the first bit position of shift register 17 is sensed by bias circuit 18 which applies a 15G bias to accelerometer 10 which causes the output from accelerometer 10 to increase by 15G's as represented in FIG. 3. In a string of 0's read out of memory 16 the first 0 will cause bias circuit 18 to apply the 15G bias to accelerometer 10 and the subsequent 0's do not change this. In the event that the acceleration sensed by accelerometer 10 for the second sample period is not within the acceleration profile for the missile for the exemplary arming keyword a 0 is read out of memory 16 and is serially placed in shift register 17 behind the initial 0 placed therein. This invalid second 0 will eventually cause comparator 19 to determine that there is not a match and the ARMING SIGNAL will not be generated. In addition, a 0, whether or not a valid second bit, being placed in shift register 17 as the second bit read out of memory 16 will allow bias circuit 18 to continue applying a 15G bias to accelerometer 10. In the event that accelerometer 10 is sensing a valid acceleration profile the second sample bit read out of memory 16 is a 1 which is shifted into shift register 17. This 1 bit is in the first bit position of shift register 17 and is sensed by bias circuit 18 which responds thereto to remove the 15G bias it is applying to accelerometer 10. This operation is reflected in FIG. 3. In a string of 1's read out of memory 16 the first 1 will cause bias circuit 18 to remove bias and the subsequent ones do not change this.

Assuming that the acceleration sensed by accelerometer 10 is at least initially within the bounds of the acceleration profile for the missile, the output from analog-to-digital converter 12 will be a binary number indicating that the acceleration being sensed is between 12 and 16G's during the first sample time period of one-quarter to one-half second. In response to this binary number a 0 is read out of memory 16 as represented in FIG. 4 but is replaced by the 0 from AND gate 16 in the first position of shift register 17. During the second sample period, with the 15G bias applied, the acceleration sensed by accelerometer 10 causes the output of analog-to-digital converter 12 to output a binary number indicating that the sensed acceleration is between 30 and 32G's in the time period between one-half and three-quarters seconds. This causes a 1 to be read out of memory 16, as represented by FIG. 4, which is placed in shift register 17 behind the 0. In the third sample period between three quarter and one second the sensed acceleration causes an output from analog-to-digital converter 12 indicating that the acceleration is between 15 and 18G's and causes a 1 to be read out of memory 16 as indicated in FIG. 4 which is placed in shift register 17. This process is continued through each of the twenty samples occurring between one-quarter second and five and one-quarter seconds. Each time a 0 is placed in the first bit position of shift register 17, bias circuit 18 applies the 15G bias to accelerometer 10, and each 1 appearing in the first bit position of shift register 17 bias circuit 18 causes the 15G bias to be removed.

While what has been described hereinabove is the preferred embodiment of my invention, it would be obvious to those skilled in the art that many changes may be made without departing from the spirit and the scope of the invention. While the description has described a missile warhead as the projectile, it could be used with other munition delivery systems such as torpedoes and artillery shells.

What is claimed is:

1. A safing and arming device for arming a warhead on a projectile subsequent to its launch comprising:

means for sensing when said missile is experiencing a threshold acceleration and providing a first signal indicating same, and means enabled by said first signal for checking the acceleration of said projectile at a plurality of points in time subsequent to its launch to determine if the projectile is undergoing a proper acceleration profile and to provide an arming signal used to arm said warhead when the acceleration profile is that for the projectile in proper flight.

2. The invention in accordance with claim 1 further comprising:

means jointly responsive to said sensing means and to an indication that said projectile has been deliberately launched to generate a start signal used to enable said checking means to check the acceleration profile of said projectile.

3. The invention in accordance with claims 1, wherein said checking means comprises:

means responsive to said sensing means for producing a binary number indicating the acceleration profile of said projectile, and means for checking said binary number to determine if it matches a proper acceleration profile for the projectile, and to generate an arming signal used to arm said warhead if it is determined that said projectile is undergoing its proper acceleration profile.

4. The invention in accordance with claim 3 wherein said sensing means includes an accelerometer having a sensing element and further comprising:

means responsive to said binary number to occasionally bias said accelerometer to move the sensing element to prevent it from mechanically binding up.

5. The invention in accordance with claim 1 wherein said sensing means comprises:

an accelerometer sensing the acceleration of said projectile and generating an analog voltage output indicating the acceleration, and an acceleration threshold detector responsive to said analog voltage output to provide said first signal.

6. The invention in accordance with claim 1 wherein said means for checking the acceleration of said projectile comprises:

means for converting said analog voltage from said accelerometer to a first binary number which changes as said analog voltage changes, and memory means from which a series of binary numbers is serially read out over a period of time, said memory means being read out jointly responsive to said first binary number and to the time since said first signal is generated, said series of binary numbers indicating the acceleration profile over said period of time, said series of binary numbers to be checked to determine if the acceleration profile said projectile is undergoing is the proper acceleration profile for the projectile.

7. The invention in accordance with claim 6 wherein an arming key word is stored as one of the series of binary numbers in said memory and is only read out of said memory upon said projectile being accelerated through its proper acceleration profile during said period of time, and said acceleration checking means further comprising:

a register into which whatever series of binary numbers is serially read out of said memory is stored, and means for comparing the series of binary numbers stored in said register with said arming key word series of binary numbers and only upon the two series of binary numbers being identical said comparing means generates said arming signal used to arm said warhead.

8. The invention in accordance with claim 7 further comprising:

means for analyzing any binary number read out of said memory and being responsive to a first predetermined binary number to apply a bias to said accelerometer to prevent it from mechanically binding up, and removing said bias responsive to a second predetermined binary number, the locations in said memory in which said arming word series of binary numbers is stored being addressed by the digitized output of said accelerometer both when said bias is present and is not present.

9. The invention in accordance with claim 8 wherein each of said binary numbers is a zero or a one and further comprising:

means for forcing a zero or a one into said register in lieu of the first binary number read out of said memory to prevent the series of binary numbers stored in said register for an improper acceleration profile of said projectile from erroneously being inverted to becoming said arming key word series of binary numbers and wrongfully cause the arming of said warhead.

10. A safing and arming device for arming a warhead on a projectile subsequent to its launch comprising:

means for checking the acceleration of said projectile at a plurality of points in time subsequent to its launch to determine if the projectile is undergoing a proper acceleration profile for the projectile and to provide a signal used to arm said warhead when the acceleration profile is that for the projectile in proper flight.

* * * * *